US007470157B2

(12) United States Patent
Hiramatsu

(10) Patent No.: US 7,470,157 B2
(45) Date of Patent: Dec. 30, 2008

(54) CONNECTOR

(75) Inventor: Hiroyuki Hiramatsu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/823,908

(22) Filed: Jun. 29, 2007

(65) Prior Publication Data

US 2008/0009201 A1 Jan. 10, 2008

(30) Foreign Application Priority Data

Jul. 4, 2006 (JP) ..... 2006-184705

(51) Int. Cl.
*H01R 13/514* (2006.01)

(52) U.S. Cl. ..... 439/752; 439/595

(58) Field of Classification Search ..... 439/752, 439/595

See application file for complete search history.

(56) References Cited

U.S. PATENT DOCUMENTS 4,946,398 A * 8/1990 Takenouchi et al. ..... 439/599
5,240,433 A * 8/1993 Kato ..... 439/587
5,322,457 A * 6/1994 Tsuji et al. ..... 439/595
5,607,327 A * 3/1997 Tsuji et al. ..... 439/752
5,931,707 A * 8/1999 Ito ..... 439/752
6,193,551 B1 * 2/2001 Yamamoto et al. ..... 439/595
6,537,108 B2 * 3/2003 Sasaki ..... 439/595
6,994,597 B2 * 2/2006 Majima ..... 439/752
7,195,522 B2 * 3/2007 Okada et al. ..... 439/752
2002/0028610 A1 * 3/2002 Oyamada ..... 439/752
2002/0168895 A1 * 11/2002 Suzuki ..... 439/595
2002/0197915 A1 * 12/2002 Mase et al. ..... 439/752
2003/0100230 A1 * 5/2003 Tsuji et al. ..... 439/752
2003/0148669 A1 * 8/2003 Ishikawa et al. ..... 439/752
2005/0085138 A1 * 4/2005 Tsuji ..... 439/752

FOREIGN PATENT DOCUMENTS

JP 2005-166608 6/2005

* cited by examiner

*Primary Examiner*—Neil Abrams
*Assistant Examiner*—Harshad C Patel
(74) *Attorney, Agent, or Firm*—Gerald E. Hespos; Anthony J. Casella

(57) ABSTRACT

A connector has a front retainer (30) that can be held at a partial or full locking position, engaging portions (38) formed on outer surfaces of locking arms (36) are engaged with partial locks (15) or full locks (16). Thus, even if resilient deforming portions (37) of the locking arms (36) are deformed to widen the spacing therebetween due to a thermal shrinkage at the time of resin-molding, areas of engagement of the engaging portions (38) and the partial locks (15) and those of the engaging portions (38) and the full locks (16) are not reduced. Further, engaged parts of the engaging portions (38) and the partial or full locks (15, 16) are in insertion spaces (14), and the front retainer (30) will not be unlocked by interference of external matter.

15 Claims, 6 Drawing Sheets

CONNECTOR

BACKGROUND OF THE INVENTION

1. Field of the Invention

The invention relates to a connector.

2. Description of the Related Art

Japanese Unexamined Patent Publication No. 2005-166608 discloses a connector with a housing made of a synthetic resin and adapted to accommodate terminal fittings. A front retainer made of a synthetic resin is mounted into the housing from the front. Two locking arms project from the front retainer and engage outer side surfaces of the housing to hold the retainer temporarily at a partial locking position. The terminal fittings can be inserted into and withdrawn from the housing when the front retainer is at the partial locking position. However, the front retainer can be pushed towards the housing and into a full locking position for retaining the terminal fittings in the housing.

A molded synthetic resin article generally deforms due to a thermal shrinkage as the resin is cured. Thus, thermal shrinkage could reduce an area of engagement between the front retainer and the housing in the above-described connector. In other words, an outward deformation of the locking arms due to thermal shrinkage could reduce the area of engagement and could cause the locking arms to separate from the outer side surfaces of the housing.

The invention was developed in view of the above situation, and an object thereof is to reliably hold a front retainer locked.

SUMMARY OF THE INVENTION

The invention relates to a connector with a housing made of a resin and including at least one cavity for accommodating at least one terminal fitting. The connector also includes a front retainer made of a resin and adapted to retain the terminal fitting when the front retainer is mounted in a proper position on the front of the housing. The front retainer includes a front wall. At least one locking arm projects back from the front wall and is formed with an engaging portion. The housing is formed with at least one insertion space for receiving the locking arm from the front. At least one lock is formed on a wall of the insertion space to face the locking arm substantially in a direction of thermal deformation resulting from molding the locking arm. The lock arm engages the engaging portion to hold the front retainer on the housing.

The locking arm enters the insertion space in the housing when the front retainer is mounted to the housing. As a result, the engaging portion of the locking arm engages the lock of the insertion space to retain the front retainer on the housing. The lock is on the surface of the insertion space to face the locking arm substantially in a direction in which the molded locking arm is expected to deform due to thermal shrinkage. Thus, an area of engagement between the lock and the engaging portion will not decrease even if the lock arm undergoes thermal shrinkage. Further, the engaged parts of the engaging portion and the lock are in the insertion space, and external matter will not unlock the front retainer.

The front retainer preferably can be held either at a partial locking position or a full locking position in the housing. Insertion and withdrawal of the terminal fitting into and from the housing are permitted when the front retainer is at the partial locking position. However, withdrawal of the terminal fitting from the housing is prevented when the front retainer is at the full locking position.

The front retainer preferably has two locking arms, and the engaging portion is formed on an outer surface of each locking arm.

The housing preferably has two insertion spaces for receiving the corresponding locking arms.

A partial lock and a full lock preferably are formed on a surface of each insertion space. The partial lock engages an engaging portion on the outer surface of the lock arm to hold the front retainer at the partial locking position. The full lock engages the engaging portion on the outer surface of the lock arm to hold the front retainer at the full locking position.

The engaging portions on the outer surfaces of the locking arms engage the partial locks or the full locks to hold the front retainer at the partial locking position or at the full locking position. Thus, the areas of engagement between the engaging portions and either the partial locks or the full locks will not be reduced even if the locking arms are deformed to widen the spacing therebetween due to the thermal shrinkage during the resin-molding,.

The front retainer preferably has at least one side wall substantially continuous with and at an angle to both the front wall and the locking arm. The side wall preferably is formed with at least one retaining portion for retaining the at least one terminal fitting.

The side wall is continuous with and at an angle to both the front wall and the locking arm. As a result, the locking arm is difficult to deform Further, the side wall also functions to retain the terminal fitting. Thus, the shape of the front retainer can be simplified as compared to the case where exclusive means are provided to prevent deformation of the locking arm.

At least one recess preferably is formed in the front surface of the housing for accommodating the front wall when the front retainer is mounted in the proper position in the housing.

Error mounting preventing means preferably are formed near the opening edge of the recess and/or the outer peripheral edge of the front wall and engage each other only when the front retainer is oriented properly in the housing. Thus, the front retainer cannot be mounted in the housing in an improper orientation.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector according to the invention is described with reference to FIGS. 1 to 7. The connector has a housing 10 in the form a vertically long block made e.g. of a synthetic resin. A connecting end of the housing 10 with an unillustrated mating connector is at the left in FIG. 1 and is referred to as the front.

Figure 1:
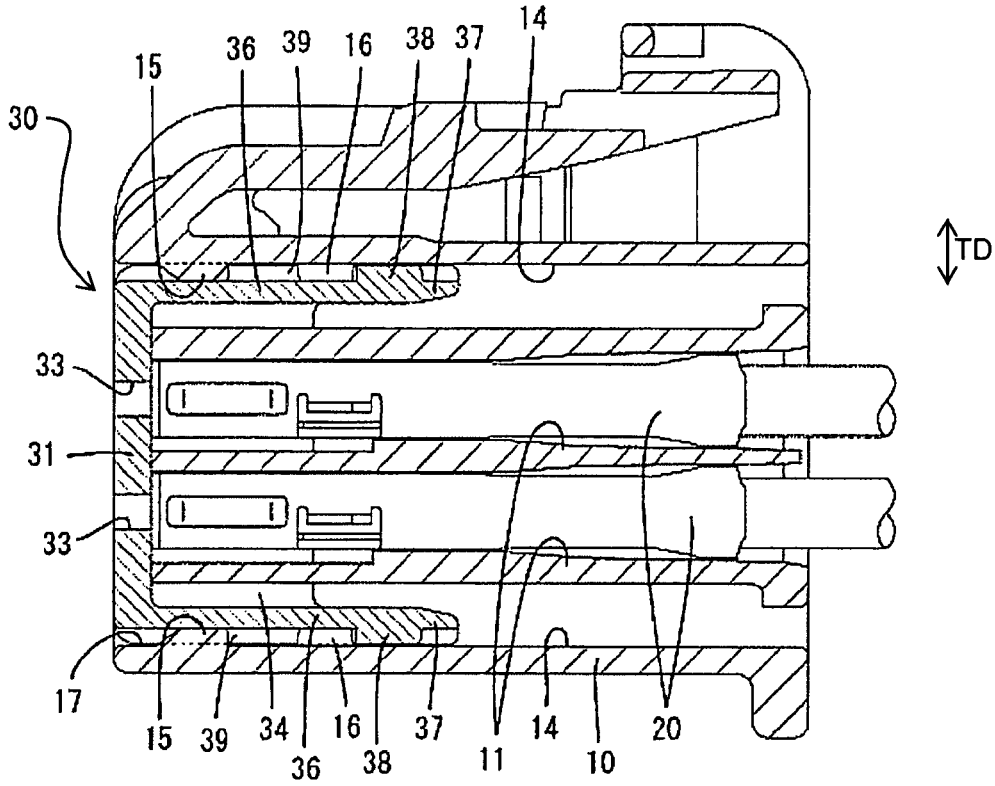
FIG. 1 is a section showing a state where a front retainer is mounted at a full locking position in-one embodiment.
Figure 2:
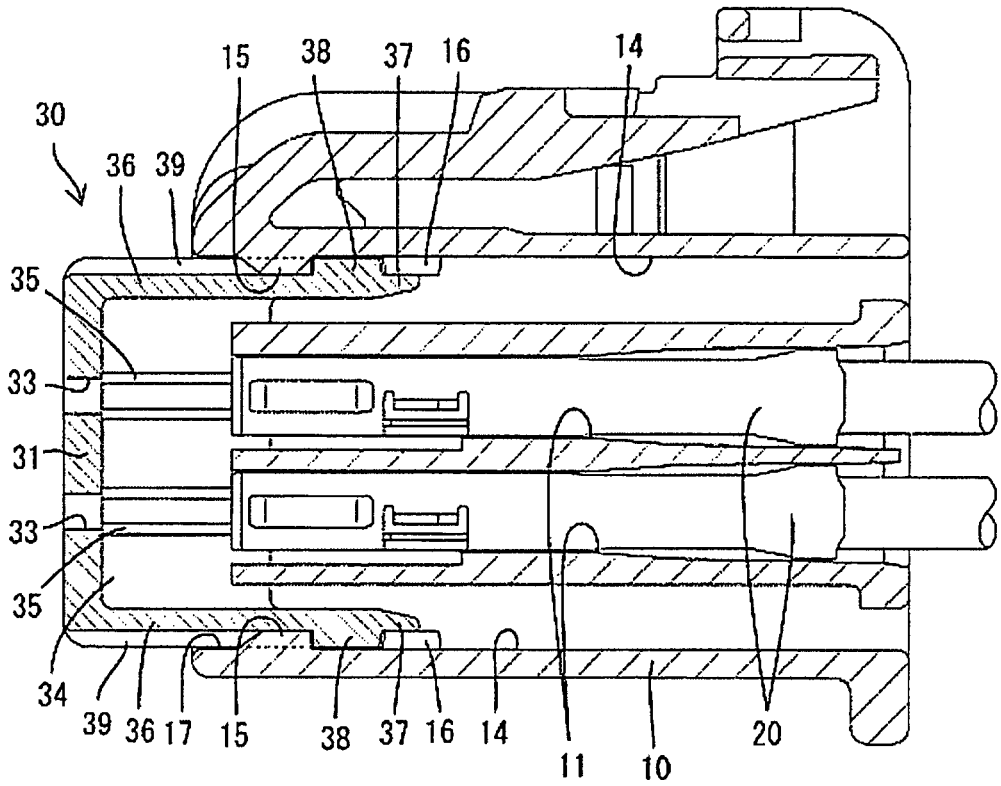
FIG. 2 is a section showing a state where the front retainer is mounted at a partial locking position.
Figure 3:
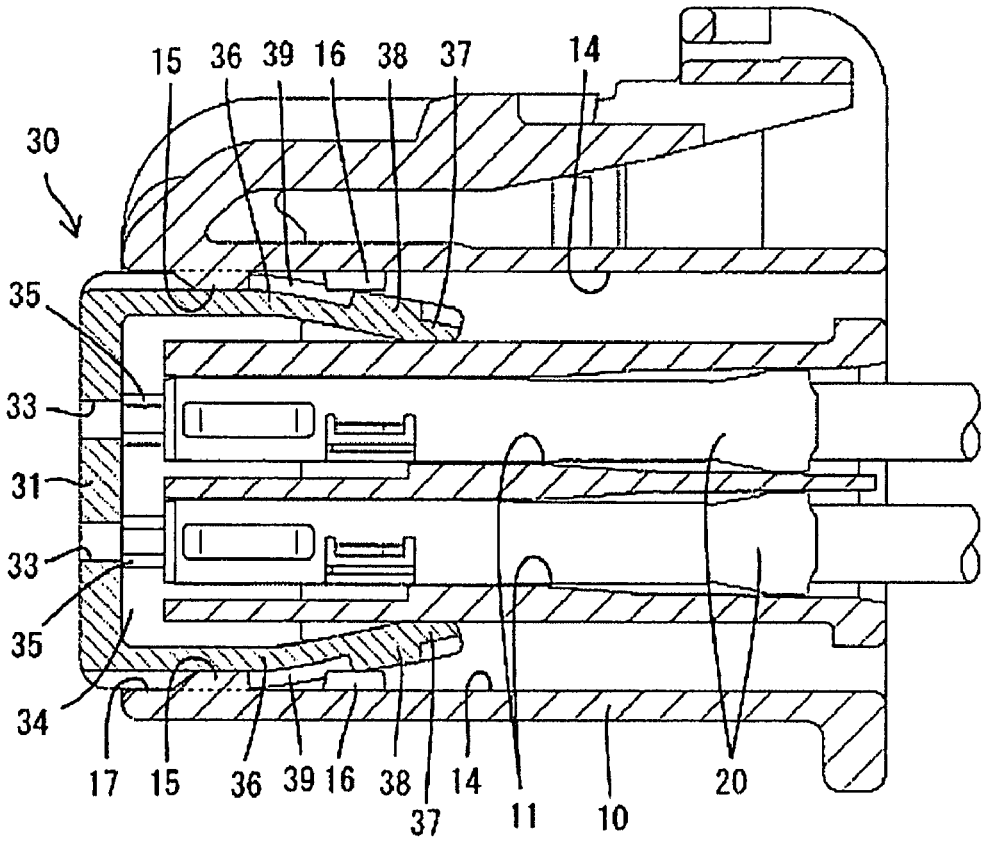
FIG. 3 is a section showing an intermediate state of a movement of the front retainer between the partial and full locking positions.
Figure 4:
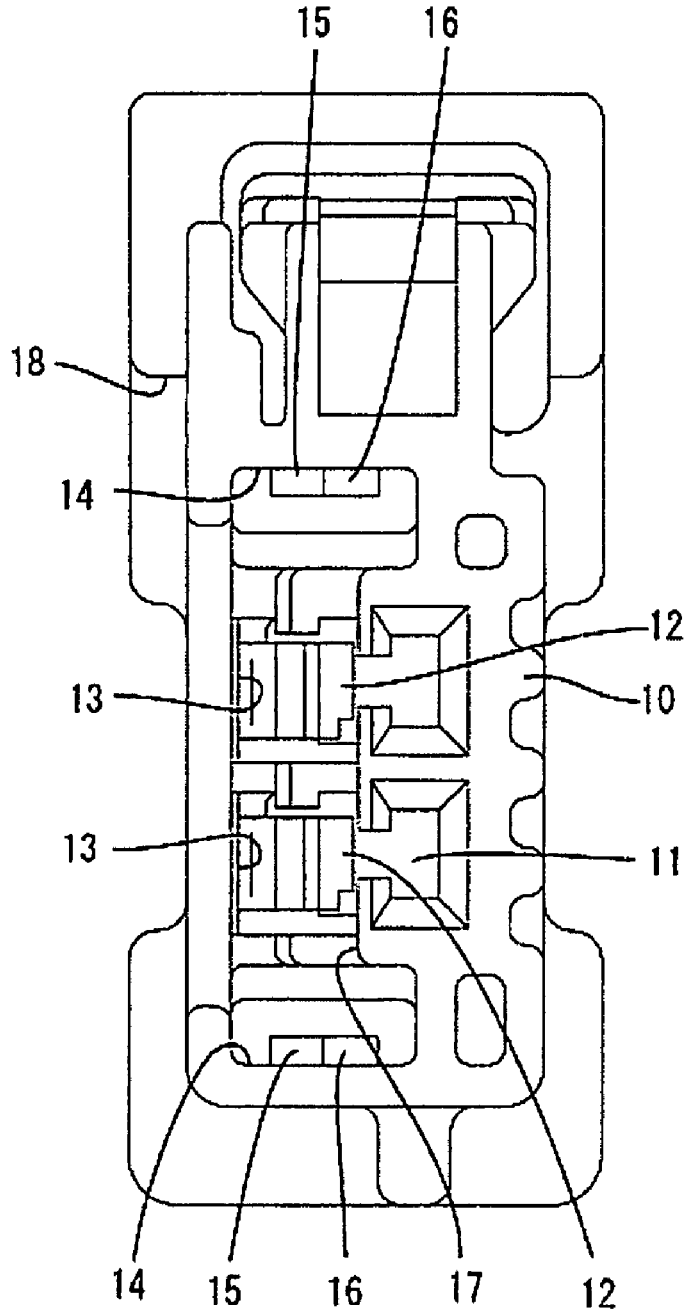
FIG. 4 is a front view of a housing.
Figure 5:
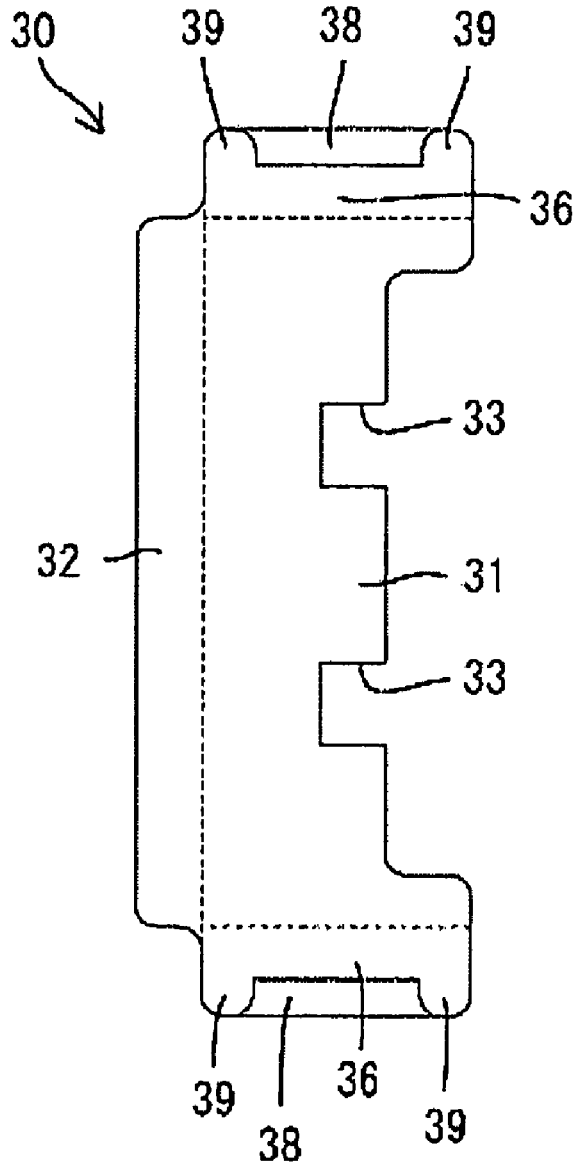
FIG. 5 is a front view of the front retainer.
Figure 6:
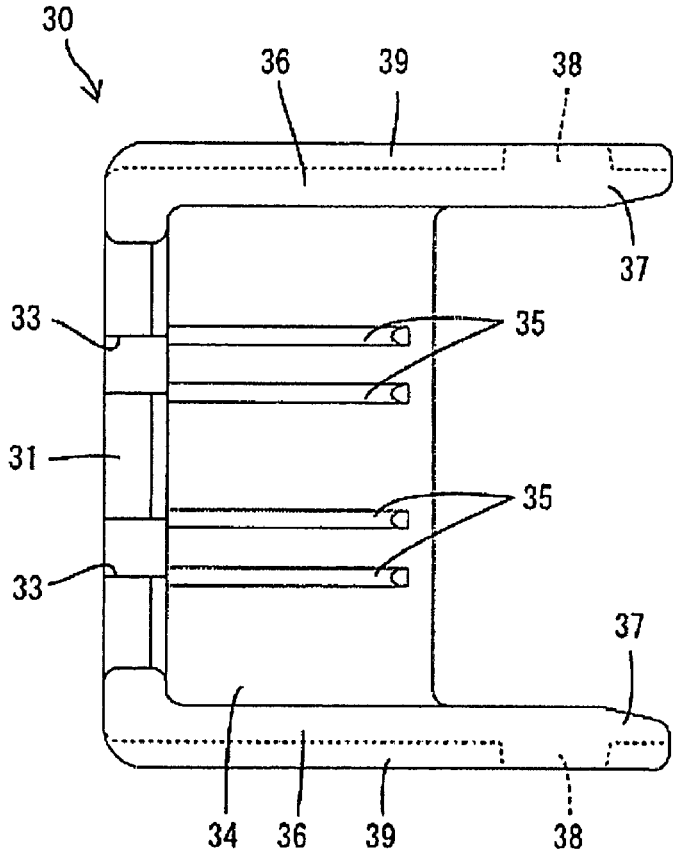
FIG. 6 is a side view of the front retainer.
Figure 7:
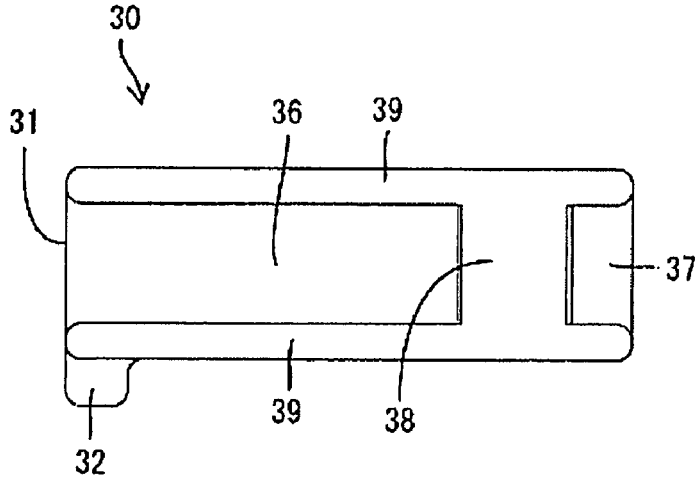
FIG. 7 is a bottom view of the front retainer.

Cavities 11 penetrate the housing 10 from the front end to the rear end and female terminal fittings 20 are inserted into the respective cavities 11 from behind (right side in FIGS. 1 to 3). A lock 12 extends along an inner wall of each cavity 11 and engages the terminal fitting 20 to retain the terminal fitting 20 in the respective cavity 11. The lock 12 deforms resiliently at an intermediate stage of the insertion of the terminal fitting 20 and enters a deformation space 13 that opens at the front of the housing 10.

Upper and lower insertion spaces 14 are formed symmetrically in the housing 10 at positions above and below the cavities 11. Thus, the insertion spaces 14 extend substantially along upper and lower walls of the housing 10, and penetrate the housing 10 to open in the front and rear surfaces of the housing 10. A partial lock 15 projects down and in from a position close to the front end of the ceiling wall of the upper insertion space 14 and a full lock 16 projects down and in from the ceiling wall of the upper insertion space 14 at a position behind the partial lock 15. On the other hand, a partial lock 15 projects up and in from a position close to the front end of the bottom wall of the lower insertion space 14 and a full lock 16 projects up and in from the bottom wall of the lower insertion space 14 at a position behind the partial lock 15.

A vertically long recess 17 is formed in the front surface of the housing 10. The recess 17 includes a formation area of the locks 12, a formation area of the deformation spaces 13 and formation areas of the upper and lower insertion spaces 14. A lateral side of the opening edge of the recess 17 opposite to the cavities 11 is cut off except the upper and lower ends to form an error mounting preventing portion 18.

The connector also includes a unitarily formed front retainer 30 that has a front wall 31 configured to be mounted on the front surface of the housing 10. Upper and lower locking arms 36 cantilever back from upper and lower edges of the front wall 31 and a side wall 34 bulges back from one lateral edge of the front wall 31. The front retainer 30 can be mounted on the housing 10 from the front and held selectively at partial or full locking positions.

The front wall 31 is fit into the recess 17 when the front retainer 30 is at the full locking position. Further, an error mounting preventing rib 32 projects sideways form the lateral edge of the front wall 31 where the side wall 34 bulges out and is engageable with the error mounting preventing portion 18 of the recess 17 of the housing 10. On the other hand, the lateral edge of the front wall 31 opposite to the side wall 34 is recessed at positions corresponding to the locks 12 and the openings of the deformation spaces 13 form escaping portions 33.

The side wall 34 extends continuously at a substantially right angle from the front wall 31, and is located in the deformation spaces 13 of the housing 10 when the front retainer 30 is at the full locking position. Rib-shaped retaining portions 35 are formed on the inner surface of the side wall 34 and contact the locks 12 when the front retainer 30 is at the full locking position to prevent deformation of the locks 12 away from the terminal fittings 20 and towards the deformation spaces 13. The retaining portions 35 do not interfere with the locks 12 when the front retainer 30 is at the partial locking position and permit resilient deformations of the locks 12 towards the deformation spaces 13. Upper and lower end edges of the side wall 34 are substantially continuous with and normal to lateral edges of the upper and lower locking arms 36.

The locking arms 36 are plate-shaped and are aligned at right angles to the front wall 31 and the side wall 34. Rear ends of the locking arms 36 project back beyond the rear of the side wall 34. Resilient deforming portions 37 are defined at the projecting rear ends of the locking arms 36 and can deform resiliently up and down along the thickness direction TD of the locking arms 36 with the front ends as supports. The thickness of each locking arm 36 including the resilient deforming portion 37 is substantially constant and is smaller than the height of the insertion space 14. An engaging portion 38 projects out and up from the resilient deforming portion 37 of the upper locking arm 36, whereas an engaging portion 38 projects out and down from the resilient deforming portion 37 of the lower locking arm 36. Guide ribs 39 project along the opposite left and right edges of the upper surface of the upper locking arm 36, and upper surfaces of the guide ribs 39 are substantially flush with the upper surface of the engaging portion 38. On the other hand, guide ribs 39 project along the opposite left and right edges of the lower surface of the lower locking arm 36, and the lower surfaces of the guide ribs 39 are substantially flush with lower surfaces of the corresponding engaging portion 38.

The front retainer 30 thermally shrinks after being molded. As a result the locking arms 36 tend to deform outward to widen the spacing therebetween as the front retainer 30 thermally shrinks.

The front retainer 30 can be brought closer to the housing 10 so that the free ends of the upper and lower locking arms 36 enter into the respective insertion spaces 14. At this time, the guide ribs 39 slide in contact with the surfaces of the insertion spaces 14 that have the partial locks 15 and the full locks 16. As a result, the front retainer 30 is guided so as not to move vertically relative to the housing 10. The engaging portions 38 interfere with the partial locks 15 when the locking arms 36 are inserted. Therefore the resilient deforming portion 37 of the upper locking arm 36 is deformed in and down and the resilient deforming portion 37 of the lower locking arm 36 is deformed in and up. In other words, the upper and lower resilient deforming portions 37 are deformed towards each other, and the engaging portions 38 pass the partial locks 15 due the deformations of the resilient deforming portions 37.

The upper and lower resilient deforming portions 37 are restored resiliently to fit the engaging portions 38 between the partial locks 15 and the full locks 16 when the engaging portions 38 completely pass the partial locks 15. Thus, the front retainer 30 is held at the partial locking position. At this time, the side wall 34 is fit only lightly into the deformation spaces 13, and the resilient deformations of the locks 12 are permitted. Further, the front wall 31 is spaced forward from the front recess 17 of the housing 10. In this partly locked state, the terminal fittings 20 are inserted into the cavities 11 from behind.

The front wall 31 is pushed to move the front retainer 30 from the partial locking position to the full locking position after the all of the terminal fittings 20 have been inserted. During this movement, the engaging portions 38 interfere with the full locks 16 to deform the upper and lower resilient deforming portions 37, thereby enabling the engaging portions 38 to pass the full locks 16.

The upper and lower resilient deforming portions 37 restore resiliently when the engaging portions 38 completely pass the full locks 16, and the engaging portions 38 engage the full locks 16 from behind to prevent a returning movement of the front retainer 30 towards the partial locking position.

Further, the front wall 31 is fit into the recess 17 and contacts the front surface of the housing 10 to prevent any further backward movement of the front retainer 30. In this way, the front retainer 30 is held at the full locking position in the housing 10. In this state, the side wall 34 is inserted deeply in the deformation spaces 13 and the retaining portions 35 prevent the locks 12 from deforming away from the terminal fittings 20. Therefore the terminal fittings 20 are locked doubly.

The locking arms 36 can be inserted rearwardly into the insertion spaces 14 at an initial stage of the mounting operation, if the front retainer 30 is in an improper orientation (i.e. upside-down). However, the error mounting preventing portion 32 of the front retainer 30 will contact part of the front of the housing 10 where the recess 17 is not formed immediately before the front retainer 30 can be pushed to the full locking position to prevent further movement of the front retainer 30. In other words, the front retainer 30 cannot be moved to the full locking position in the improper posture. Contrary to this, the error mounting preventing portion 32 of the properly oriented front retainer 30 engages the error mounting preventing portion 32 of the housing 10 so that the front retainer 30 can be moved to the full locking position.

An unillustrated jig may be inserted into the housing 10 through the escaping portion 33 of the front retainer 30 to return the front retainer 30 from the full locking position to the partial locking position. The jig then is used to deform the lock 12 into the deformation space 13 so that the terminal fitting 20 can be removed.

The engaging portions 38 on the outer surfaces of the locking arms 36 engage the partial locks 15 or the full locks 16 when the front retainer 30 is held at the partial locking position or at the full locking position. Thus, areas of engagement between the engaging portions 38 and the partial locks 15 or between the engaging portions 38 and the full locks 16 are not reduced even if the locking arms 36 are deformed to widen the spacing therebetween due to the thermal shrinkage when the front retainer 30 is resin-molded. Further, since the engaged parts of the engaging portions 38 and the partial locks 15 and those of the engaging portions 38 and the common lock portions 16 are accommodated in the insertion spaces 14, there is no likelihood of unlocking the front retainer 30 by the interference of external matter from the outside.

The side wall 34 is substantially continuous with and substantially normal to both the front wall 31 and the locking arms 36. Thus, the locking arms 36 are more difficult to deform. In other words, the side wall 34 functions as means for preventing the deformations of the locking arms 36. Further, since the side wall 34 is formed with the retaining portions 35 and also functions as means for retaining the terminal fittings 20, the shape of the front retainer 30 can be simplified as compared to the case where exclusive means is formed to prevent the deformations of the locking arms 36.

The recess 17 for accommodating the front wall 31 when the front retainer 30 is at the full locking position is formed in the front of the housing 10 and the error mounting preventing portions 18, 32 engageable with each other only when the front retainer 30 is mounted in the proper orientation into the housing 10 are formed at the opening edge of the recess 17 and the outer peripheral edge of the front wall 31. This can prevent the front retainer 30 from being mounted in an improper orientation into the housing 10.

The invention is not limited to the above described and illustrated embodiment. For example, the following embodiments are also embraced by the technical scope of the present invention as defined by the claims.

The locking arms may be asymmetric and the number of the locking arms does not matter.

The engaging portions may be in the form of recesses instead of being in the form of projections.

The partial locks may be in the form of recesses instead of being in the form of projections.

According to the present invention, the partial locks and the full locks may be in the form of recesses instead of being in the form of projections.

The side wall may be not continuous with the locking arms.

The housing may be a male housing instead of a female housing.

The front retainer need not be engageable in the partially locked state.

The engaging portions may be at the inner sides of the locking arms and the locks may be arranged to face the locking arms if the locking arms are expected to be deform in.

What is claimed is:

1. A connector, comprising:

a housing made of a resin and including at least one cavity for accommodating at least one terminal fitting, a resiliently deformable lock projecting into the cavity and a deformation space being defined on a side of the lock opposite the cavity, the lock being deformable into the deformation space during insertion of the terminal fitting into the cavity and resiliently returning towards the cavity for engaging the terminal fitting that has been inserted into the cavity; and a front retainer made of a resin and having a side wall insertable into the deformation space to prevent deformation on the lock away from the terminal fitting to retain the terminal fitting upon being mounted to a proper position on the housing;

wherein:

the front retainer includes a front wall, at least one locking arm projecting back from the front wall and formed with an engaging portion and the housing having at least one insertion space for receiving the locking arm, at least one lock being formed on a wall surface of the insertion space to face the locking arm substantially in a direction of thermal deformation resulting from the molding of the locking arm, the lock being configured for engaging the engaging portion and holding the front retainer on the housing.

2. The connector of claim 1, wherein the front retainer can be selectively held at a partial locking position where the side wall is spaced from the deformation space and a full locking position in the housing where the side wall is in the deformation space, insertion and withdrawal of the terminal fitting into and from the housing are permitted when the front retainer is at the partial locking position, and withdrawal of the terminal fitting from the housing being prevented when the front retainer is at the full locking position.

3. The connector of claim 1, wherein the front retainer includes two opposed locking arms, each locking arm having the engaging portion formed on an outer surface thereof facing away from the other of the locking arms.

4. The connector of claim 3, wherein the housing is formed with two insertion spaces for receiving the corresponding locking arms.

5. The connector claim 4, wherein a partial lock and a full lock are formed on an outer wall surface of each insertion space the partial lock being configured for engaging the corresponding engaging portion and holding the front retainer at the partial locking position, the full lock being configured for engaging the corresponding engaging portion for holding the front retainer at the full locking position.

6. The connector of the claim 1, wherein the side wall is substantially continuous with and substantially normal to the front wall and the locking arm.

7. The connector of claim 6, wherein the side wall is formed with at least one retaining portion for retaining the at least one terminal fitting.

8. The connector of claim 1, wherein a recess is formed in the front of the housing for accommodating the front wall when the front retainer is mounted in the proper position on the housing.

9. The connector of claim 8, wherein error mounting preventing portions are formed in proximity to the opening edge of the recess and are engageable with each other only when the front retainer is mounted in a proper orientation on the housing.

10. A connector, comprising:

a housing including at least one cavity for accommodating at least one terminal fitting, a resiliently deformable terminal lock projecting into the cavity, a deformation space defined on the side of the terminal lock opposite the cavity, the terminal lock being configured to deform into the deformation space during insertion of the terminal fitting into the cavity and resiliently returning after the terminal fitting has been inserted for locking the terminal fitting in the cavity, the housing having first and second outer walls spaced outwardly from the cavity and defining first and second insertion spaces in the housing between the outer walls and the cavity, at least one lock formed on each of the outer walls, the locks projecting into the insertion space and towards the cavity; and a retainer made of a resin and having a front wall, a side wall projecting from the front wall and configured for insertion into the deformation space when the terminal lock is not deformed to prevent deformation of the lock away from the terminal fitting, and first and second opposed locking arms extending from the front wall, the first and second locking arms being insertable into the first and second insertion spaces respectively, at least one engaging portion formed on surfaces of each of the locking arms facing away from the other of the locking arms the engaging portions being disposed for engaging the lock in the respective insertion space for holding the retainer on the housing, whereby the engaging portions are disposed to achieve secure engagement with the locks despite an outward deformation of the locking arms in response to thermal shrinkage of the resin.

11. The connector of claim 10, wherein the retainer further includes at least one retaining portion formed on the side wall and configured to retain the terminal fitting in the cavity when the retainer is mounted to proper position on the housing.

12. The connector of claim 11, wherein the locking arms are substantially parallel.

13. The connector of claim 12, further comprising a side wall extending between portions of the locking arms adjacent the front wall.

14. The connector of claim 13, wherein the retaining portion is on the side wall.

15. The connector of claim 14, wherein the at least one lock comprises first and second locks in each of the insertion spaces for selectively locking the retainer in either of a first position and a second position on the housing.

* * * * *